US005730292A

United States Patent [19]

Jones

[11] Patent Number: 5,730,292

[45] Date of Patent: Mar. 24, 1998

[54] METHOD AND APPARATUS FOR IDENTIFYING INSULIN VIALS

[76] Inventor: Terry Lee Jones, P. O. Box 958, Sanger, Tex. 76266

[21] Appl. No.: 702,339

[22] Filed: Aug. 23, 1996

[51] Int. Cl.[6] ..... B65D 69/00; B65D 71/00

[52] U.S. Cl. ..... 206/534; 206/459.5; 215/230

[58] Field of Search ..... 206/459.5, 534, 206/570; 215/230, 306; 220/375

[56] References Cited

U.S. PATENT DOCUMENTS

| | | | |
|---|---|---|---|
| 1,937,674 | 12/1933 | Teason | 220/375 |
| 4,203,524 | 5/1980 | Wieland | 215/306 |
| 4,674,640 | 6/1987 | Asa et al. . | |
| 4,753,358 | 6/1988 | Virca et al. | 215/306 |
| 5,011,032 | 4/1991 | Rollman | 206/534 |
| 5,115,930 | 5/1992 | Lohrman et al. . | |
| 5,254,314 | 10/1993 | Yu et al. . | |
| 5,280,834 | 1/1994 | Berkley | 206/5.1 |
| 5,377,853 | 1/1995 | Papciak . | |
| 5,497,879 | 3/1996 | Kao | 215/230 |

*Primary Examiner*—Paul T. Sewell
*Assistant Examiner*—Nhan T. Lam
*Attorney, Agent, or Firm*—Locke Purnell Rain Harrell

[57] ABSTRACT

A system of color-coded vial caps, with tactile raised symbols on top, to help diabetic patients, even visually impaired patients, or their care providers distinguish between insulin types. The system is comprised of six different vial caps, all the same size, with the tops of the caps having distinctive tactile markings designed to correspond to the six types of insulin currently on the market. In addition, the six types of caps each have a distinct color. The IDD patient or their care giver can attach the color-coded, tactile marked cap to the corresponding insulin vial making the insulin vial more distinguishable from another vial containing a different type of insulin.

5 Claims, 2 Drawing Sheets

METHOD AND APPARATUS FOR IDENTIFYING INSULIN VIALS

FIELD OF THE INVENTION

The present invention relates to a method and apparatus for product identification. More particularly, the present invention relates to a method and apparatus for identification of and between the six standard types of insulin.

BACKGROUND OF THE INVENTION

Insulin comes in six different varieties: regular, lente, ultra lente, NPH, 70/30, and 50/50. At any given time, an Insulin Dependent Diabetic ("IDD") patient might require one specific type of insulin. In documented cases nationwide, IDD patients who require one type of insulin have been accidentally administered the wrong type of insulin. Accidental dosing from the wrong insulin vial due to indistinct labels on the vials has led to critical and sometimes fatal outcomes for IDD patients. Current insulin vials are identified with only black and white labels adhesively attached to the vials. A simple misreading of such a non-distinctive label can prove tragic. Further, for those visually impaired IDD patients, distinguishing between black and white, non-tactile labels can prove difficult or impossible. This is particularly vital with insulin since diabetes is the leading cause of blindness in the United States.

Many containers currently exist which have caps that are integrally connected to a strap or tether which can be connected to the container so that when the cap is removed from the container mouth, the cap remains tethered to the container by the strap. Often these caps come in various colors and with tactile markings. However, the lack of a uniform system of tactile markings and/or color codes corresponding to particular types of insulin limits the usefulness of prior art caps for IDD patients. There is a particular problem if color-coding is the only source of identification with the prior art caps and there are multiple medication types and corresponding colors which must be remembered, especially under emergency circumstances. Additionally, because supplemental identification to the prior art caps are often in the form of an adhesive label, which can cause a problem if the supplemental label becomes detached from the vial. Essentially, if the patient cannot remember which color-coding corresponds to which medicine, identification of the medicine becomes impossible without careful examination of the product label.

SUMMARY OF THE INVENTION

The present invention solves the aforementioned and other problems by providing an identification system comprised of color-coded insulin identification caps with tactile symbols on the end cap to help IDD patients, even sight-impaired IDD patients, or their care providers to distinguish easily and quickly between insulin types, even in emergency circumstances.

The identification cap is preferably constructed of a flexible material and includes an end cap which fits over the mouth of the insulin vial and has a tactile marking which identifies a particular type of insulin. The end cap has a thumb tab allowing it to be easily secured on or pushed off the mouth of the insulin vial. Opposite the thumb tab, the end cap is integrally formed with a retaining band which connects the end cap to a securing ring. The securing ring fits around the neck of the vial and keeps the end cap secured to the insulin vial even when the end cap is not secured over the mouth of vial. The securing ring is flexible and of an appropriate size to allow it to be stretched over the mouth of a standard insulin vial and to be securely fitted around the neck of the insulin vial. The end cap is of appropriate depth and diameter to fit securely over, and totally enclose, the mouth of the insulin vial and the stopper which is fitted into the mouth of the vial and prevents the insulin in the vial from escaping. There are six different identification caps, all the same size with the tops of the end caps having distinctive tactile markings designed to correspond to the labels indicating the six types of insulin currently on the market. In addition, each of the six identification systems has a particular and distinct color. The identification caps are preferably molded from a flexible material of the appropriate color. In the preferred embodiment of the present invention, the color scheme of the caps is: regular insulin—red identification cap, lente insulin —blue identification cap, ultra lente insulin—yellow identification cap, NPH insulin —green identification cap, 70/30insulin—orange identification cap, 50/50 insulin—white identification cap.

To use the identification system to identify vials containing particular types of insulin a cap is provided of a color corresponding to the particular type of insulin. The identification cap includes an end cap a retaining band and a securing ring. The end cap has a tactile marking which also corresponds to the type of insulin in the vial as well as the color code. The securing ring of the identification cap is stretched over the mouth and secured around the neck of an insulin vial containing the proper type of insulin. The end cap is then placed over the mouth of the insulin vial. To identify the type of insulin in the vial a user may now consult the color code of the identification cap or may read the tactile marking on the top of the end cap either visually or by touch.

The purpose of the identification system is to assist the IDD patient, including sight—impaired IDD patients, and their care givers with identification of different types of insulin. The color—coded tactile marked caps make each vial more distinguishable from the other five vials.

BRIEF DESCRIPTION OF THE DRAWINGS

The invention can be more fully understood by referencing the accompanying drawings wherein.

DETAILED DESCRIPTION OF THE PREFERRED EMBODIMENT

Figure 1:
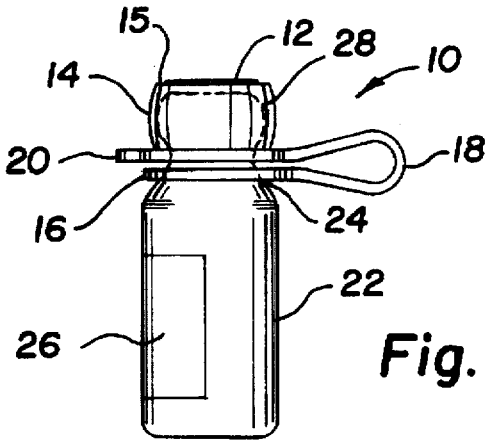
FIG. 1 is a side view of the identification cap of the present invention attached to and closed on an insulin vial.

Referring now to the drawings, wherein like reference characters denote corresponding parts.

Figure 2A:
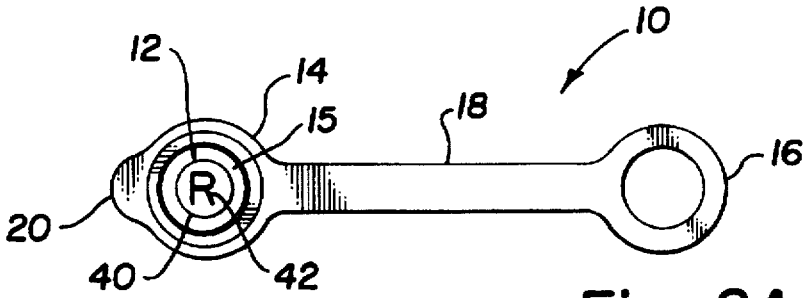
FIG. 2A is a top view of the identification cap of the present invention including a tactile marking for one of the six different types of insulin.
Figure 2B:
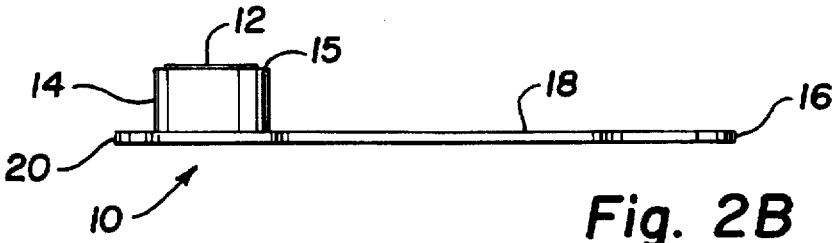
FIG. 2B is a side view of the identification cap of FIG. 2A.
Figure 3:
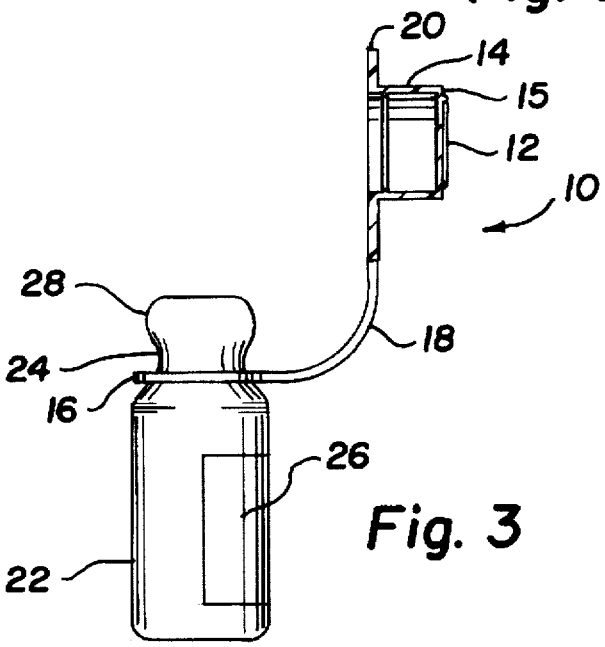
FIG. 3 is a side view of the identification cap of FIG. 2A attached to the insulin vial in an open position.

As shown in FIGS. 1 through 3, the invention is directed towards an identification cap 10 with tactile symbol 12 on end cap 14 of identification cap 10, to help IDD patients, including sight-impaired IDD patients, or their care providers distinguish between insulin types. Either before or after the prescription for the insulin is dispensed, an identification cap 10 is attached to the insulin vial 22. Identification cap 10 includes a tactile symbol 12 on top 15 of end cap 14 and is formed by a colored flexible material wherein both tactile marking 12 and the color of the flexible material coordinate with the type of insulin in insulin vial 22. For example, if insulin vial 22 contained regular insulin, label 26 adhesively attached to insulin vial 22 would indicate that regular insulin was contained in the vial. As a result, identification cap 10 to be placed on insulin vial 22, in the preferred embodiment of the present invention, would be marked with capital "R" 42 surrounded by circle 40 as shown in FIG. 2A. Additionally, identification cap 10, corresponding to regular insulin would be formed in a unique color, such as red in the preferred embodiment. Color and marking combinations corresponding to each particular type of insulin of used to form a distinct identification cap 10 which uniquely identifies the type of insulin in insulin vial 22. This combination of identifying characteristics allows IDD patients or their care givers to identify the type of insulin in a particular vial by any of three methods. First, the insulin can be identified by the color of identifying cap 10. Second, tactile marking 12 can be visually inspected, or third, tactile marking 12 can be identified by touching its unique characteristics such as circle 40 from FIG. 2A. This touch identification is vital for visually impaired IDD patients, particularly because diabetes is the leading cause of blindness in the United States.

FIG. 1 shows identification cap 10 of the present invention attached to an insulin vial 22. Securing ring 16 of identification cap 10 is attached around neck 24 of insulin vial 22. As stated, securing ring 16 is attached to end cap 14 by retaining band 18 which are all integrally formed using a flexible material which can be formed in different distinct colors. End cap 14 is shown in a closed state secured over mouth 28 of insulin vial 22. Thumb tab 20 of identification cap 10, also integrally formed with end cap 14 can be used to help remove end cap 14 from mouth 28 of insulin vial 22.

FIGS. 2A and 2B show the preferred embodiment of the present invention relating to identification cap 10 for identifying regular insulin. End cap 14, connected to securing ring 16 by retaining band 18, includes tactile marking 12. To identify regular insulin, tactile marking 12 is formed by capital "R" 42 surrounded by circle 40. Circle 40 is raised slightly higher than capital "R" 42 to aid identification by visually impaired IDD patients. Identification cap 10 is also formed in a particular color to correspond to the regular insulin and circle R tactile marking 12. Again, red is used in the preferred embodiment to identify regular insulin.

FIG. 3 again shows identification cap 10 attached to insulin vial 22. End cap 14 is shown in the off state allowing access to mouth 28 holding a rubber stopper (not shown). When end cap 14 is off, the insulin can be extracted from insulin vial 22.

Figure 4A:
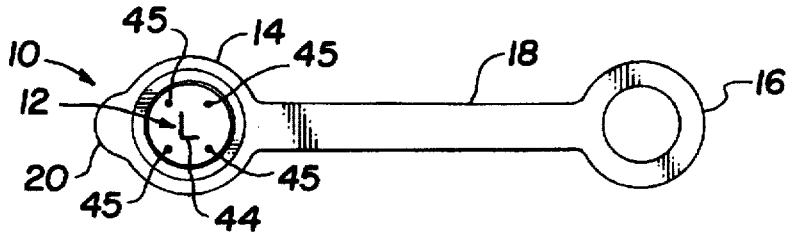
FIGS. 4A through 4E are top views of various embodiments of the identification cap of the present invention corresponding to five other types of insulin not shown by FIG. 2A.
Figure 4B:
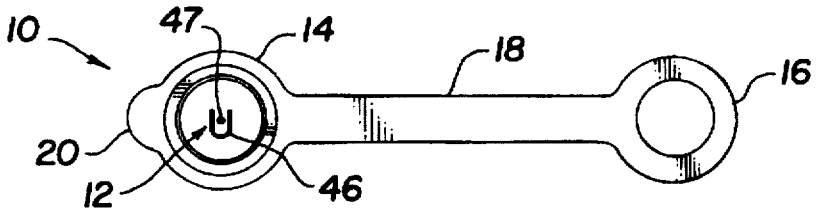
Figure 4C:
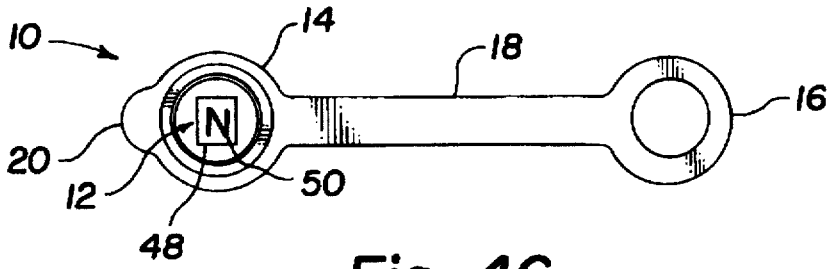
Figure 4D:
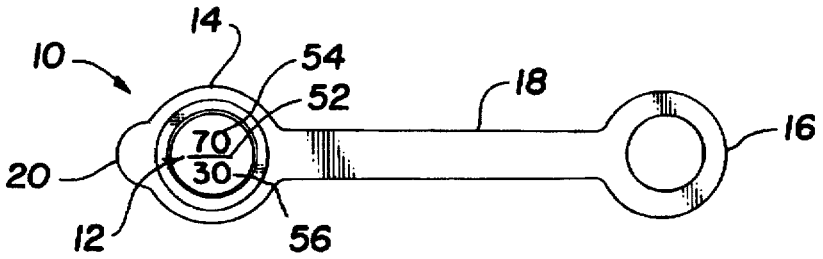
Figure 4E:
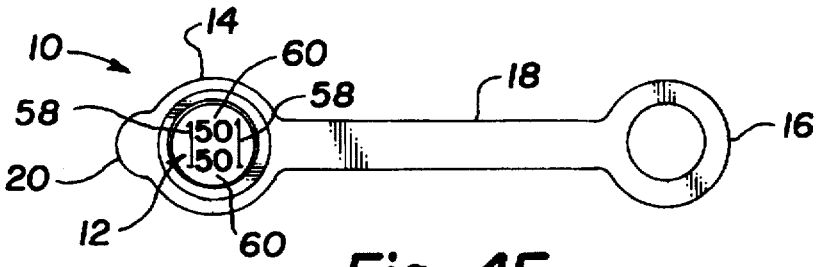

FIGS. 4A through 4E show the particular tactile markings employed in the preferred embodiment of the present invention to identify the other five types of insulin not already mentioned. FIG. 4A shows the preferred embodiment of identification cap 10 for identifying lente insulin. Tactile marking 12 on top 15 of end cap 14 if formed by capital "L" 44 with comer dots 45 which are raised slightly higher than capital "L" 44. Identification cap 10 for lente insulin is formed in blue. FIG. 4B shows the preferred embodiment of identification cap 10 for identifying ultra lente insulin. Tactile marking 12 on top 15 of end cap 14 if formed by capital "U" 46 with center dot 47, which is again raised slightly higher than capital "U" 46. Identification cap 10 for ultra lente insulin is formed in yellow. FIG. 4C shows the preferred embodiment of identification cap 10 for identifying NPH insulin. Tactile marking 12 on top 15 of end cap 14 if formed by capital "N" 50 surrounded by square 48 which is also raised slightly above capital "N" 50. Identification cap 10 for NPH insulin is formed in green. FIG. 4D shows the preferred embodiment of identification cap 10 for identifying 70/30 insulin. Tactile marking 12 on top 15 of end cap 14 is formed by horizontal bar 52 separating number "70" 54 from number "30" 56 which is under number "70" 54. Horizontal bar 52 is raised slightly above number "70" 54 and number "30" 56 to aid identification by visually impaired IDD patients. Identification cap 10 for 70/30 insulin is formed in orange. FIG. 4E shows the preferred embodiment of identification cap 10 for identifying 50/50 insulin. Tactile marking 12 on top 15 of end cap 14 if formed by numbers "50" 60 bordered on either side by horizontal bars 58 which are again raised slightly above numbers "50" 60. Identification cap 10 for 50/50 insulin is formed in white.

When the IDD patient or the care giver attempts to select the appropriate insulin, that person only needs to identify the insulin through the color-coding or through tactile symbol 12 on identification cap 10 attached to the vial. For example, if the IDD patient or the care giver required 70/30 insulin, he or she would need to either identify the color of identification cap 10 which corresponds to 70/30 insulin or identify the tactile symbol for "70/30" insulin either by sight or by touch of horizontal bar 52 from FIG. 4D, as described above, on end cap 14 of identification cap 10. After the appropriate insulin vial is identified, the IDD patient or the care giver simply, using thumb tab 20, lifts up on end cap 14. As the patient lifts up by thumb tab 20 on identification cap 10, end cap 14 will become disengaged from neck 24 of insulin vial 22. Thus, the rubber stopper (not shown) in mouth 28 of insulin vial 22 is exposed for extraction of the insulin. Even though identification cap 10 is no longer covering insulin bottle 4, securing ring 16 remains attached around neck 24 of insulin vial 22, ensuring that end cap 14 does not get lost or inadvertently transferred to another vail containing a different type of insulin. After the IDD patient has extracted the insulin from insulin vial 22, he or she simply pushes end cap 14 back over mouth 28 of insulin vial 22 in order to cover the rubber stopper. After one or more used, insulin vial 22 will become empty and, when this occurs, both insulin vial 22 and identification cap 10 are discarded.

As stated, Identification cap 10 itself is constructed of a flexible material with end cap 14 connected by retaining band 18 to securing ring 16. Securing ring 16 is of an appropriate size to allow it to be stretched over mouth 28 of a standard insulin vial currently on the market, such as insulin vial 22. Extending from one side of securing ring 16 is a band of plastic 10 which attaches securing ring 16 to end cap 14. End cap 14 is of appropriate depth and diameter to fit securely over and totally enclose mouth 28 of the standard insulin vial 22.

While the invention has been particularly shown and described with reference to a preferred embodiment, it will be understood by those skilled in the art that various changes in form and detail may be made therein without departing from the spirit and scope of the invention.

I claim:

1. A system of identification caps for identifying the type of insulin in a standard insulin vial, the system comprising:

a first identification cap for identifying regular insulin, the first identification cap having a first color and a tactile marking including a capital "R" surrounded by a circle;

a second identification cap for identifying lente insulin, the second identification cap having a second color and a tactile marking a capital "L" with four corner dots;

a third identification cap for identifying ultra lente insulin, the third identification cap having a third color and a tactile marking including a capital "U" with a center dot;

a fourth identification cap for identifying NPH insulin, the fourth identification cap having a fourth color and a tactile marking including a capital "N" surrounded by a square;

a fifth identification cap for identifying 70/30 insulin, the fifth identification cap having a fifth color and a tactile marking including a "70" separated from a "30" by a horizontal bar;

a sixth identification cap for identifying 50/50insulin, the sixth identification cap having a sixth color and a tactile marking including a first "50" over a second "50" surrounded by two vertical bars; and wherein the system, through use of the first through sixth identification caps, allows identification of the type of insulin in the standard insulin vial.

2. The system recited in claim 1 wherein the first color is red, the second color is blue, the third color is yellow, the fourth color is green, the fifth color is orange, and the sixth color is white.

3. The system of claim 1 wherein each of the six identification caps comprises:

a) a securing ring which secures the identification cap to the standard insulin vial;

b) a retaining band attached to the securing ring c) an end cap attached to the retaining band opposite the securing ring.

4. The system of claim 3 wherein the tactile marking is located on the end cap of each of the six identification caps.

5. The system of claim 3 wherein the standard insulin vial includes a mouth and a neck, and the securing ring is designed to stretch over the mouth and fit around the neck of the standard insulin vial.

* * * * *